US010767850B2

(12) United States Patent
Sturman

(10) Patent No.: US 10,767,850 B2
(45) Date of Patent: Sep. 8, 2020

(54) ATTACHING LIGHT EMITTING DEVICES TO ITEMS OF CLOTHING

(71) Applicant: Wearable Technology Limited, Leicester (GB)

(72) Inventor: Richard Sturman, Kirkby-in-Ashfield (GB)

(73) Assignee: Wearable Technology Limited, Leicester (GB)

( * ) Notice: Subject to any disclaimer, the term of this patent is extended or adjusted under 35 U.S.C. 154(b) by 0 days.

(21) Appl. No.: 16/364,394

(22) Filed: Mar. 26, 2019

(65) Prior Publication Data

US 2020/0018474 A1 Jan. 16, 2020

(30) Foreign Application Priority Data

Jul. 10, 2018 (GB) ..... 1811272

(51) Int. Cl.

| | |
|---|---|
| ***F21V 33/00*** | (2006.01) |
| ***F21V 3/06*** | (2018.01) |
| ***A41D 1/00*** | (2018.01) |
| ***A41D 1/04*** | (2006.01) |
| ***A41D 13/01*** | (2006.01) |
| ***A41D 27/08*** | (2006.01) |
| ***F21V 17/10*** | (2006.01) |
| ***F21V 23/00*** | (2015.01) |

(52) U.S. Cl.

CPC ..... *F21V 33/0008* (2013.01); *A41D 1/005* (2013.01); *A41D 1/04* (2013.01); *A41D 13/01* (2013.01); *A41D 27/085* (2013.01); *F21V 3/062* (2018.02); *F21V 17/101* (2013.01); *F21V 23/001* (2013.01)

(58) Field of Classification Search

CPC ..... F21V 33/0008; A41D 1/005; A41D 13/01; A41D 27/085

See application file for complete search history.

(56) References Cited

U.S. PATENT DOCUMENTS 2,006,504 A * 7/1935 Johnson ..... G08B 5/004 359/519
4,761,720 A * 8/1988 Solow ..... F21V 21/0808 362/235

(Continued)

FOREIGN PATENT DOCUMENTS

GB 2561885 A 10/2018

OTHER PUBLICATIONS

Corresponding Great Britain Patent Application No. GB1811272.2, Search Report dated Dec. 5, 2018.

*Primary Examiner* — Julie A Bannan

(74) *Attorney, Agent, or Firm* — Cooper Legal Group, LLC

(57) ABSTRACT

An item of clothing has a strip 502 of a reflective tape surrounded by florescent material. Embedded light-emitting devices 113 are connected to a loom of power and data cables and are supported on a flexible printed circuit board 101. Respective windows 1213 are provided for each light-emitting device, in which a hole cut through the reflective tape is covered by a clear plastics material having a first flap 1203 and a second flap 1204. The first flap is folded around the flexible printed circuit board and is secured by the second flap being further folded around the first flap. The clear plastics material is secured to the clothing fabric by an adhesive film 701 through which the holes have also been cut.

20 Claims, 16 Drawing Sheets

(56) References Cited

U.S. PATENT DOCUMENTS

| | | | | |
|---|---|---|---|---|
| 5,927,842 | A * | 7/1999 | Preisler | A41D 25/00 362/103 |
| 6,517,214 | B1 * | 2/2003 | Mitchell, Jr. | A41D 13/01 2/94 |
| 6,644,826 | B1 * | 11/2003 | Blum | B62B 5/00 362/103 |
| 7,083,296 | B2 * | 8/2006 | Chiang | A43B 1/0036 36/137 |
| 9,720,443 | B2 * | 8/2017 | Malhotra | G06F 1/163 |
| 9,861,155 | B2 * | 1/2018 | Beers | A43B 3/001 |
| 2002/0044052 | A1 * | 4/2002 | Stewart | B60Q 1/34 340/475 |
| 2006/0082987 | A1 * | 4/2006 | Dorsey | F21V 23/04 362/103 |
| 2006/0198120 | A1 * | 9/2006 | Guzman | A44C 5/00 362/103 |
| 2008/0298058 | A1 * | 12/2008 | Kan | F21V 15/01 362/240 |
| 2009/0296382 | A1 * | 12/2009 | Maier | F21V 15/01 362/218 |
| 2011/0075399 | A1 * | 3/2011 | Yuan | A41D 13/01 362/103 |
| 2011/0164406 | A1 * | 7/2011 | Chen | A45C 15/06 362/103 |
| 2012/0099298 | A1 * | 4/2012 | Hsu | A41D 27/085 362/103 |
| 2014/0376209 | A1 * | 12/2014 | Leung | F21V 33/0008 362/103 |
| 2015/0062504 | A1 * | 3/2015 | Hoshino | B42D 25/364 349/98 |
| 2016/0209448 | A1 * | 7/2016 | Currie | G08B 21/02 |

* cited by examiner

ATTACHING LIGHT EMITTING DEVICES TO ITEMS OF CLOTHING

CROSS REFERENCE TO RELATED APPLICATIONS

This application claims priority from United Kingdom Patent Application number 1811272.2, filed on Jul. 10, 2018 the whole contents of which are incorporated herein by reference.

BACKGROUND OF THE INVENTION

The present invention relates to a method of attaching a light-emitting device to an item of clothing.

The present invention also relates to an apparatus defining an item of clothing having a strip of a reflective tape surrounded by fluorescent material.

It is known to provide garments with light emitting diodes that may provide permanent illumination or that may be activated in response to detecting a particular condition. For example, as described in U.S. Pat. No. 9,992,516, assigned to the present application, red light-emitting diodes are illuminated in response to a local detection of a toxic substance and blue light-emitting diodes are activated if a substance is detected by a co-worker. In these known systems, the light-emitting diodes are supported by a rubber cover that is externally stitched to an item of clothing. Although such an approach does provide a degree of protection for the light-emitting diodes, the devices themselves are exposed and may be damaged, possibly due to the presence of dust. Furthermore, it is possible for the rubber covers to bend resulting in greater exposure of the light-emitting diodes, that may in turn result in them becoming damaged or chipped.

Increasingly, higher levels of sophistication are being provided by items of clothing of this type, including internal communication between detection devices and data transmission and storage etc. As the overall value of the items of clothing increase, there is a greater requirement for providing overall reliability; it would be undesirable for an item of clothing to be rejected due to a relatively inexpensive failure.

BRIEF SUMMARY OF THE INVENTION

According to a first aspect of the present invention, there is provided a method of attaching a light-emitting device to an item of clothing, comprising the steps of: supporting a light-emitting device on a substrate; connecting power cables to said substrate; applying an adhesive film to an inside surface of a clothing fabric; creating a hole through said adhesive film and said clothing fabric at an intended position for said light-emitting device; positioning a central portion of a clear plastics material over said hole to define a window, such that said central portion is secured by said adhesive film, a first flap extends from a first side of said central portion and a second flap extends from a second side of said central portion; locating said light-emitting device at the position of said window; folding said first flap over said substrate; further-folding said second flap over said folded first flap; and attaching said further folded second flap to said folded first flap to define a sealed enclosure for said substrate.

In an embodiment, plural light-emitting devices are supported by the substrate and the method may include a step of connecting a data cable to the substrate.

The clear plastics material may be made from any suitable compound providing this functionality but, in an embodiment, the clear plastics material is clear poly vinyl chloride.

In an embodiment, the adhesive film comprises: a central barrier film; a first adhesive layer on an outer surface; and a second adhesive layer on an inner surface. The applying step may include the steps of: removing a first backing material from the first adhesive layer; locating the first adhesive layer upon the inside surface of the clothing fabric; and applying heat and pressure to a second backing material attached to the second adhesive layer.

According to a second aspect of the present invention, there is provided an apparatus defining an item of clothing having a strip of a reflective tape surrounded by florescent material, comprising: embedded light-emitting devices connected to a loom of power and data cables and supported on a substrate; respective windows for each said light-emitting device, in which a hole cut through said reflective tape is covered, by a clear plastics material, having a first flap and a second flap, wherein: said first flap is folded around said substrate; said substrate is secured by said second flap being further folded around said first flap; and said clear plastics material is secured to a clothing fabric by an adhesive film through which said holes have also been cut.

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art. Components and processes distinguished by ordinal phrases such as "first" and "second" do not necessarily define an order or ranking of any sort.

DETAILED DESCRIPTION OF EMBODIMENTS OF THE INVENTION

FIG. 1

Figure 1:
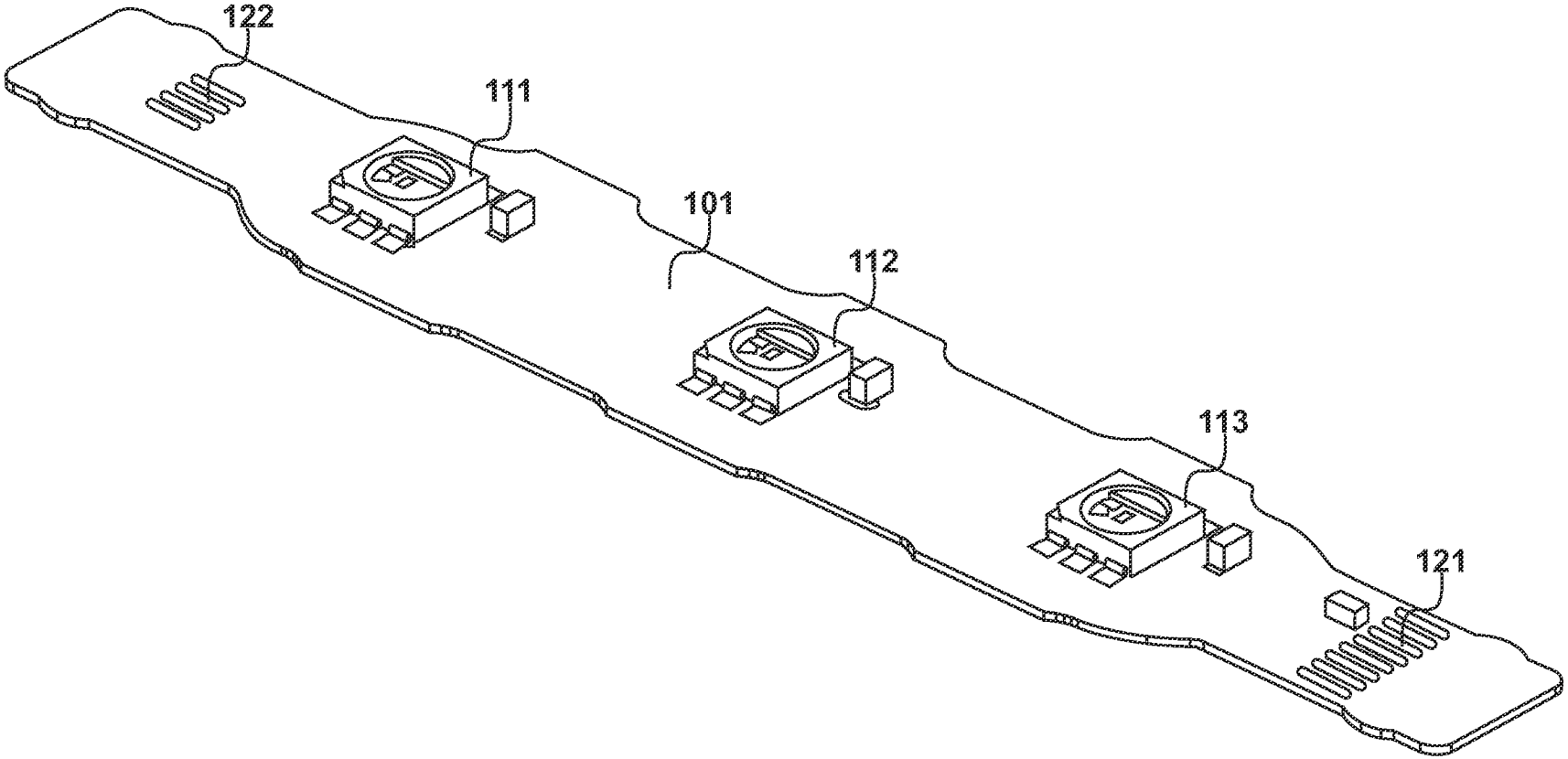
FIG. 1 shows a flexible printed circuit board with light-emitting devices.
Figure 2:
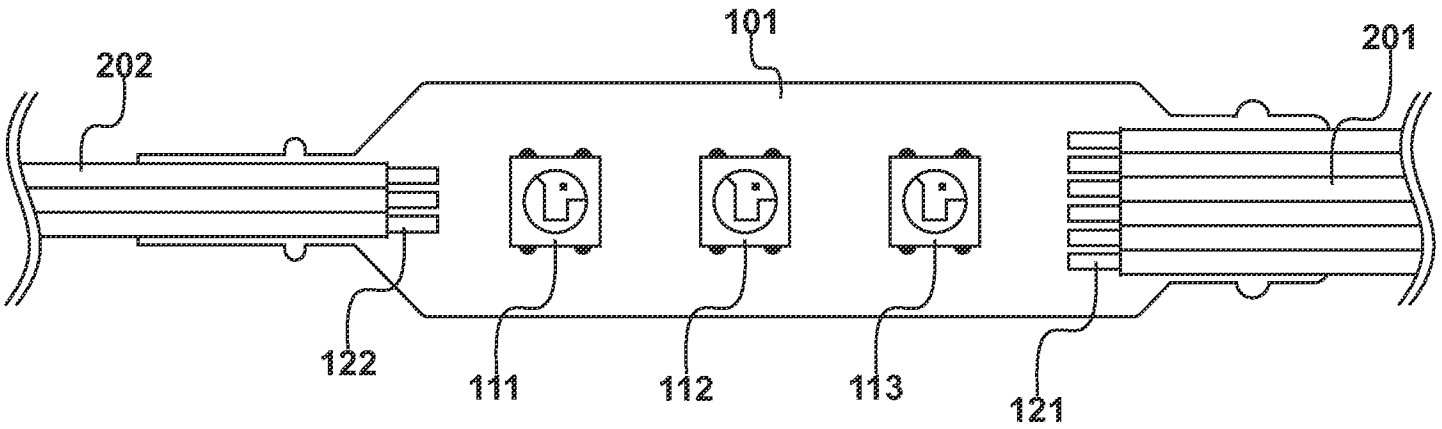
FIG. 2 shows the connection of ribbon cables.

In an embodiment, a flexible printed circuit board 101 provides a substrate for supporting a first light-emitting device 111. In this embodiment, a second light-emitting device 112 and a third light-emitting device 113 are also supported by the flexible printed circuit board 101.

A first set of contacts 121 is provided for connecting to an input side of a loom. Furthermore, a second set of contacts 122 is provided for connecting to an output side of the loom. The contacts are pre-tinned to assist with loom soldering.

FIG. 2

A loom is assembled using ribbon cables to connect flexible printed circuit boards of the type described with reference to FIG. 1. A first ribbon cable portion 201 has conductors that are soldered to the first set of contacts 121. Similarly, a second ribbon cable portion 202 has conductors that are soldered to the second set of contacts 122.

FIG. 3

Figure 3:
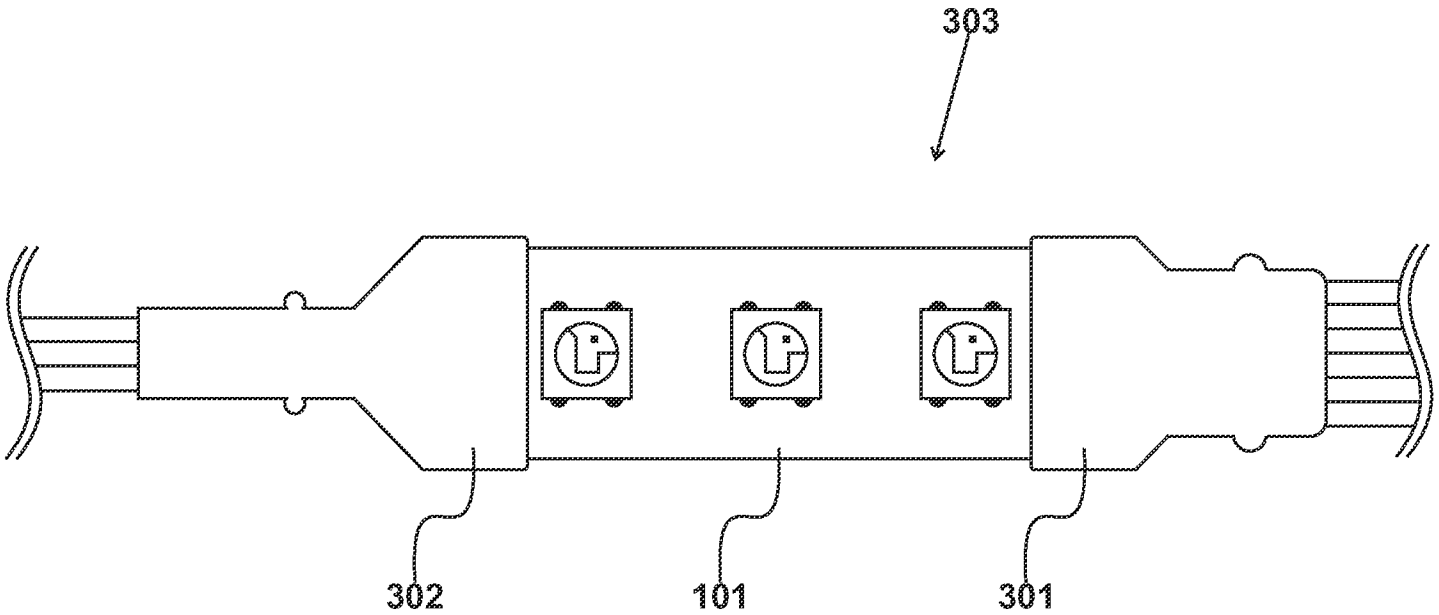
FIG. 3 shows the application of a heat shrink over the ribbon cables identified in FIG. 2.

As illustrated in FIG. 3, a first adhesive lined heat-shrink 301 is applied over the soldered connections of the first ribbon cable portion 201. Similarly, a second adhesive lined heat shrink 302 is applied over the soldered connections of the second ribbon cable portion 202.

The grouping of three LED devices on the substrate of a flexible printed circuit board, as illustrated in FIG. 3, may be identified as a device strip 303. To construct a loom, plural device strips are connected by cables and, in an embodiment, four device strips are connected in this way to construct a loom. In this embodiment, each device strip includes three light-emitting devices, although it should be appreciated that other configurations of devices are possible.

In some looms, devices may emit light of a single color in response to being energized by a control unit. However, in alternative embodiments, devices of different colors may be included in each strip. Furthermore, in an alternative embodiment, individual devices may be capable of producing multiple colors and color selection may be achieved in response to receiving control data by means of a data cable. Thus, the cables present within the loom generally include power cables and data cables. Furthermore, in addition to conveying data to the individual devices, the data cables may also be configured to receive data from detecting devices connected to the loom.

After the application of the adhesive lined heat shrinks 301/302, a clear silicone conformal coating may be applied, suitable for operating over a temperature range of between minus sixty-five degrees Celsius and two-hundred degrees Celsius. In an embodiment, the silicone coating has a thickness of two hundred micrometres, thereby preventing excessive bending of the flexible printed circuit board, to ensure that shouldered devices remain in place.

FIG. 4

Figure 4:
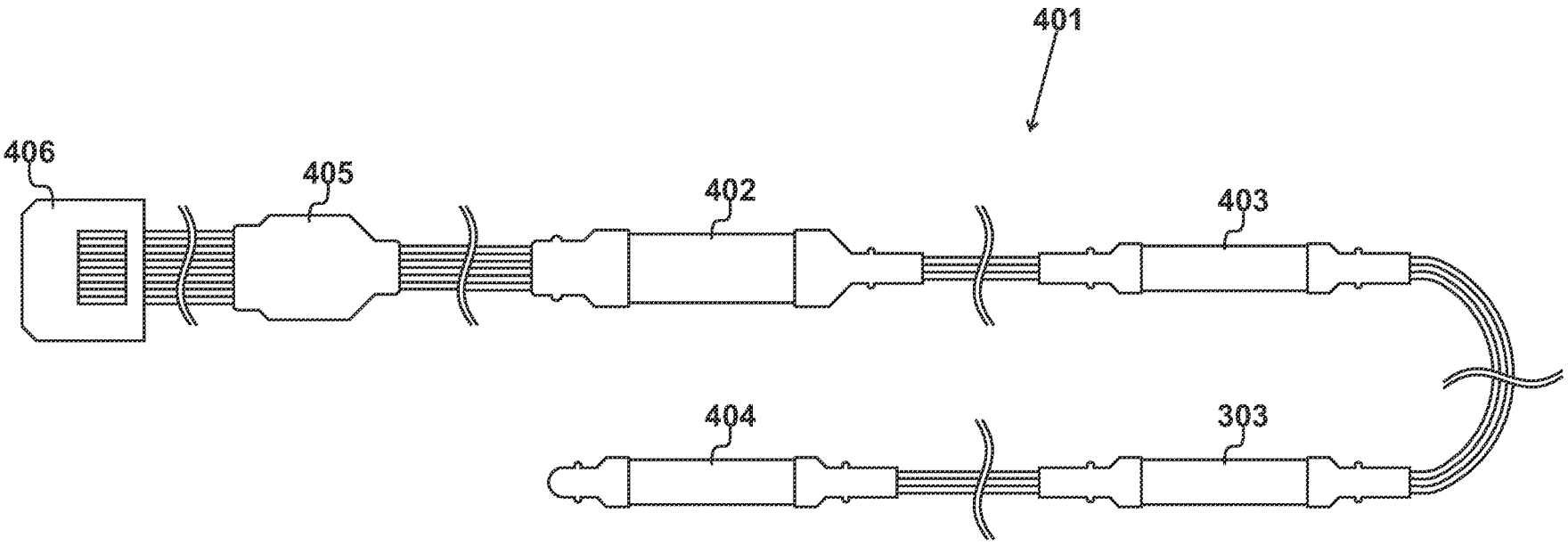
FIG. 4 shows a loom assembled from strips of the type identified in FIG. 3.

The device strip 303 is shown in FIG. 4, connected in a loom that includes a second device strip 402, a third device strip 403 and a fourth device strip 404. In an embodiment, the second device strip 402 may include enhanced functionality, possibly including detectors for detecting ambient light conditions.

In the embodiment of FIG. 4, the complete loom 401 includes an interface circuit 405 which, in an embodiment, may include memory devices for storing control instructions and/or operational data etc. In addition, a loom connector 406 is provided for connecting the loom to a control circuit.

FIG. 5

An device loom of the type described with reference to FIG. 4 is located within an item of clothing, such as that illustrated in FIG. 5. In this example, the item of clothing is a vest but the invention may be deployed in other types of clothing, such as harnesses and jackets etc.

In this example, the item of clothing is constructed from a fluorescent material 501. In addition, reflective tape 502 has been located over the fluorescent material, thereby increasing the visibility of the vest during both daylight conditions and night time conditions. This provides an external layer of material for the item of clothing which may also include an internal mesh layer.

In this embodiment, the loom 401 is restrained substantially behind the reflective tape 502. A control unit is supported within an internal pocket for receiving the loom connector 406. The control unit may be activated without it being removed from this pocket by manual pressure applied at an indicator 503. The fourth device strip 404 supports a fourth device group 504 and the first device strip 402 supports a first device group 511.

FIG. 6

Figure 5:
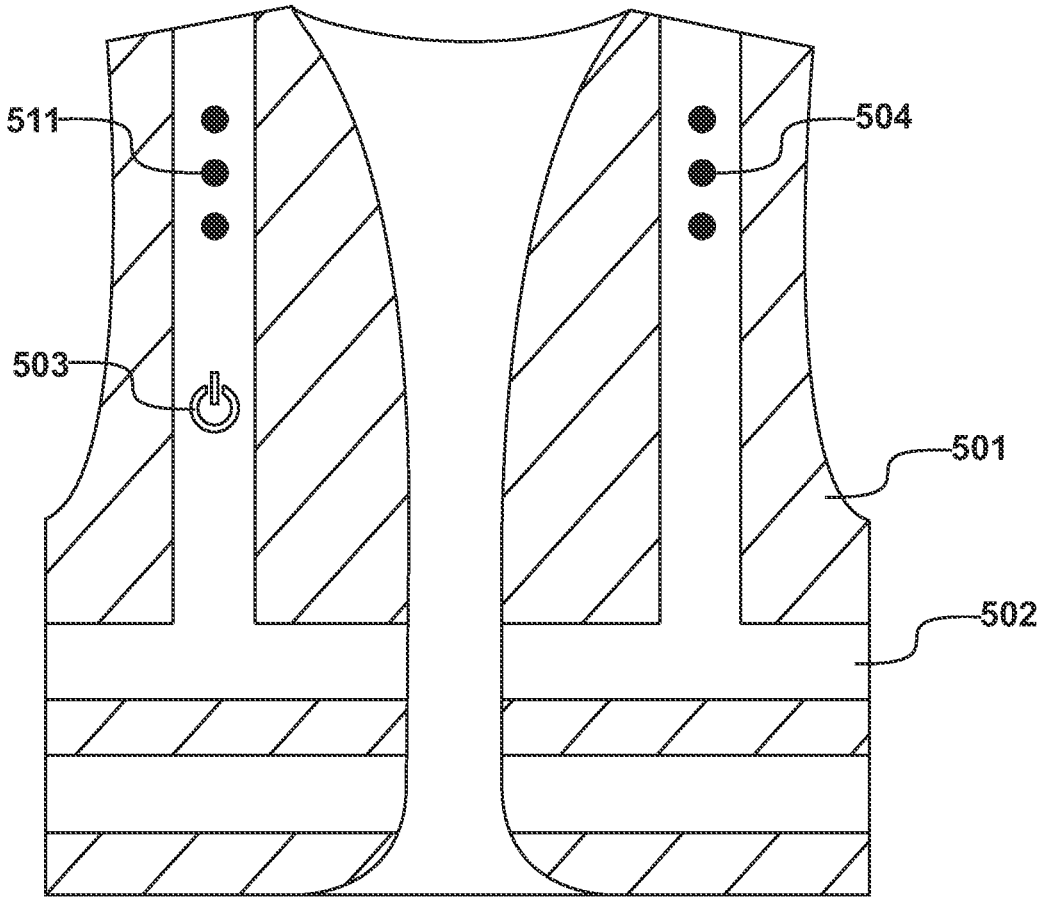
FIG. 5 shows the front of an item of clothing.
Figure 6:
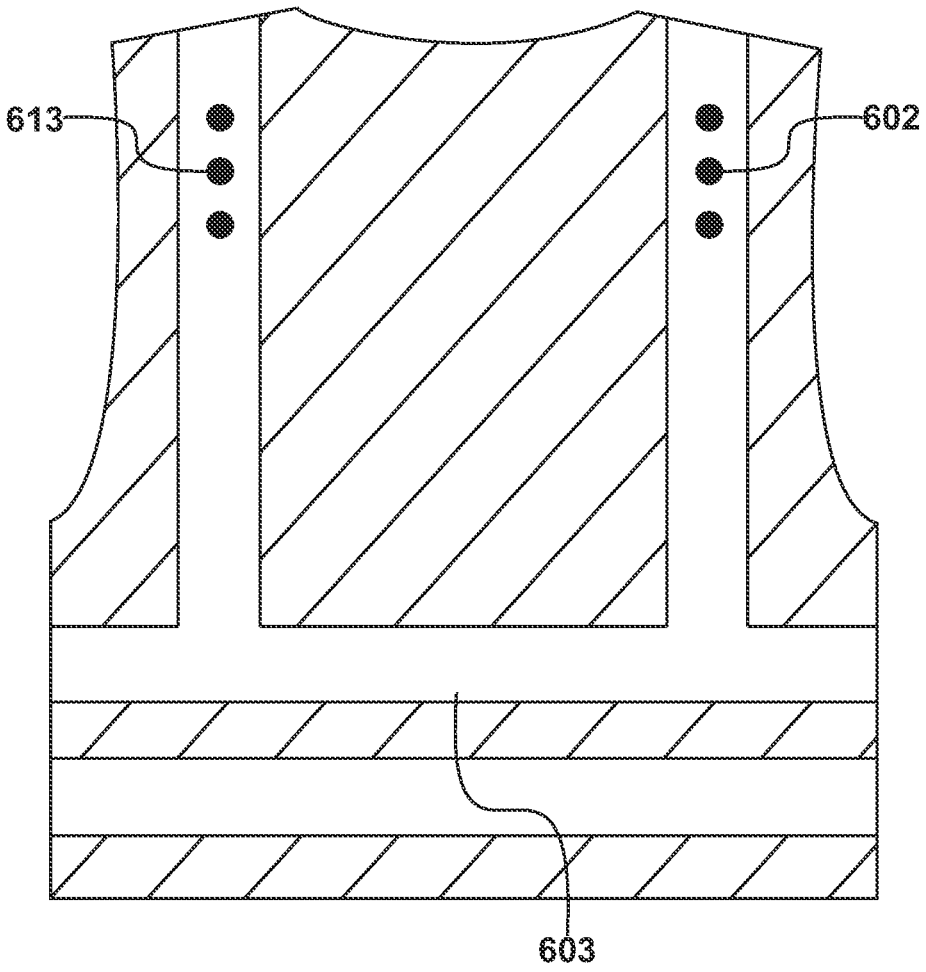
FIG. 6 shows the rear of the item of clothing identified in FIG. 5.

A rear view of the vest described with reference to FIG. 5 is illustrated in FIG. 6. A second set of devices 602 are supported by the third device strip 403. The loom then extends beneath a horizontal portion 603 to connect to a third device group 613 supported by the first LED strip 303.

FIG. 7

In accordance with an aspect of the present invention, it is desirable for the device strips to be protected as much as possible and for the light-emitting devices to be protected, while at the same time allowing light to be emitted. An embodiment therefore provides a solution by retaining the bulk of the device strips behind the reflective tape, while providing transparent windows for the emission of light from these devices. In an embodiment, a clear flexible poly vinyl chloride material is adopted but other suitable materials with appropriate flexibility could also be used.

Figure 7:
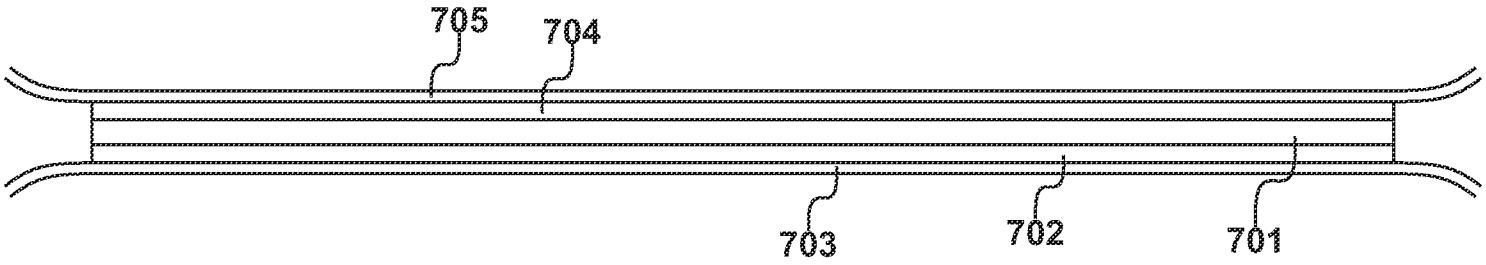
FIG. 7 illustrates a composite adhesive film.

The clear flexible poly vinyl chloride material is secured by applying an adhesive film to an inside surface of a clothing fabric. An example of a suitable film of this type is illustrated in FIG. 7. The adhesive film is a composite material that includes a mid-positioned barrier film 701.

A lower surface of the barrier film 701 contacts with a lower adhesive layer 702, which is in turn protected by a lower protective film 703, possibly implemented as a layer of grease-proofed paper. Similarly, an upper surface of the barrier film 701 is in contact with an upper adhesive layer 704, again protected by an upper protective film 705.

To achieve adhesion, the lower protective film 703 is removed and the materials brought into contact. Adhesion is then achieved by the application of pressure and heat, resulting in the creation of a seal that is mechanically strong and watertight.

FIG. 8

Figure 8:
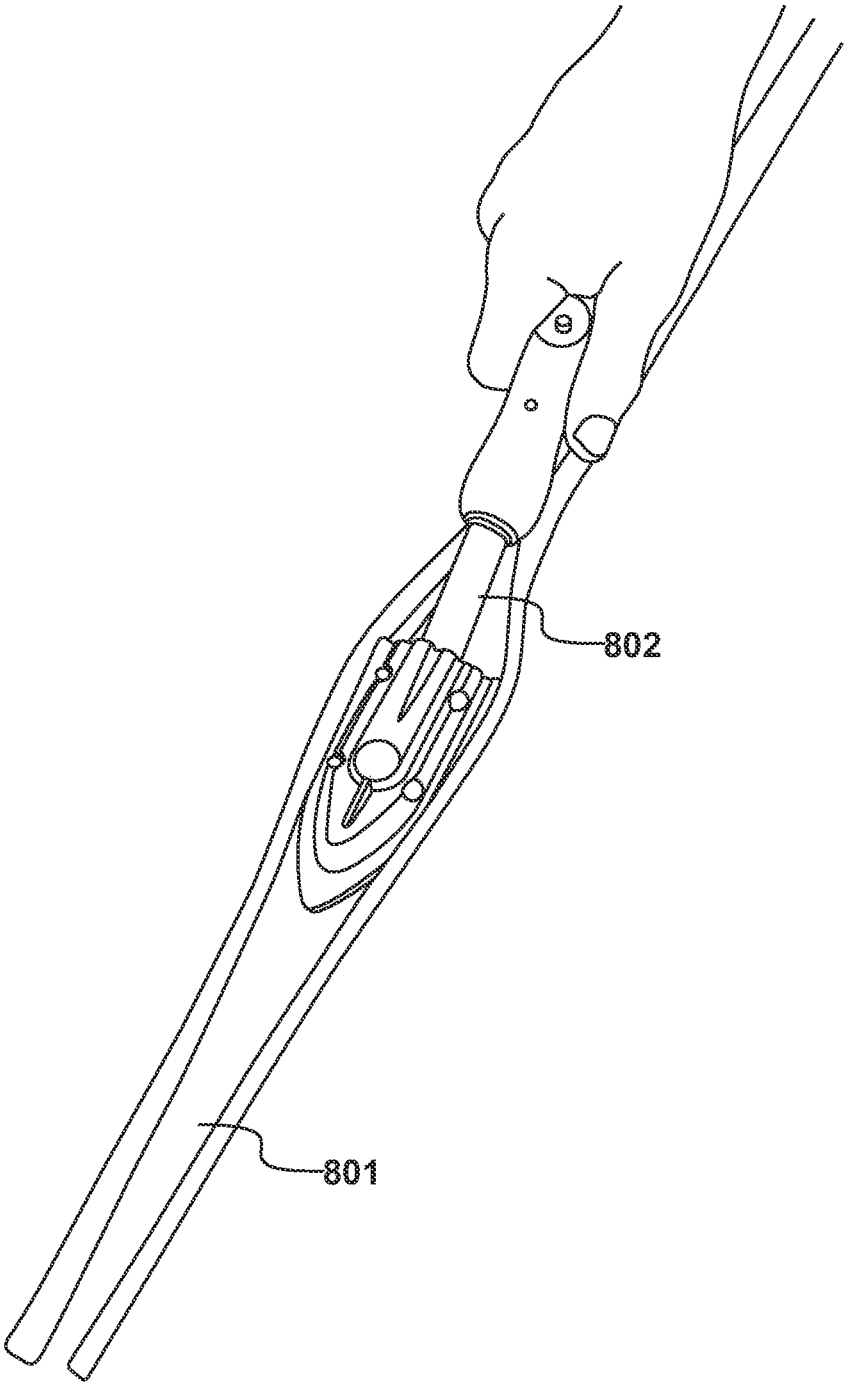
FIG. 8 illustrates the application of the adhesive film, identified in FIG. 7, to an inside surface of a clothing fabric.

An inside surface 801 of a clothing fabric is illustrated in FIG. 8. The adhesive film, described with reference to FIG. 7, is located over a portion of this inside surface after the first protective film 703 has been removed. The adhesive film is then retained in place by the application of heat and pressure, as illustrated by the application of iron 802.

FIG. 9

After the barrier film 701 has been secured to the inside surface of the clothing fabric, a template 901 is located over the second protective film 705. The template 901 includes a first hole 911, a second hole 912 and a third hole 913. The spacing between these holes 911 to 913 is compatible with the spacing between individual light-emitting devices within a device group. Thus, the holes 911 to 913 define the position of windows for the light-emitting devices.

FIG. 10

Figure 9:
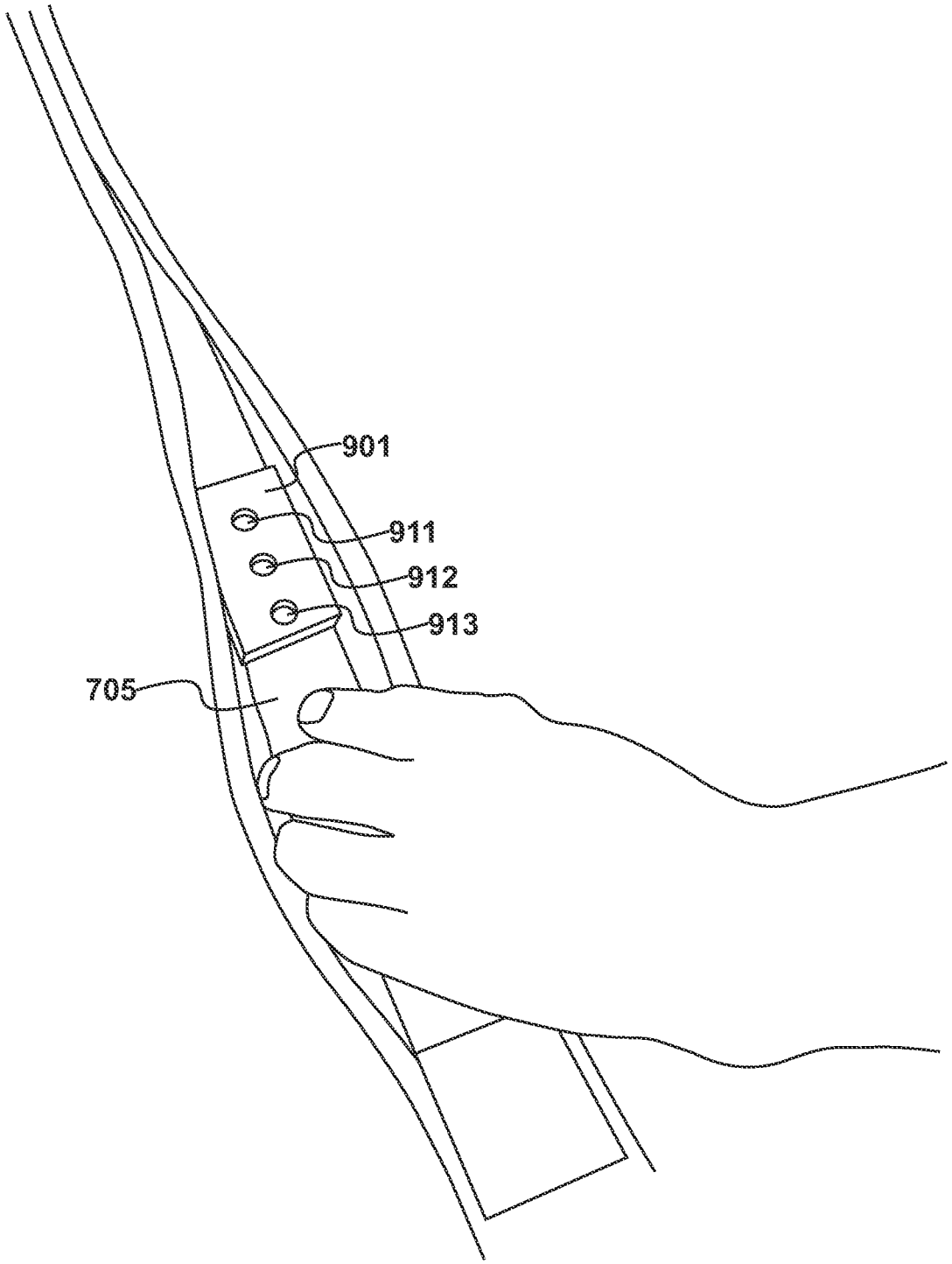
FIG. 9 illustrates the application of a template to assist with the drilling of holes.
Figure 10:
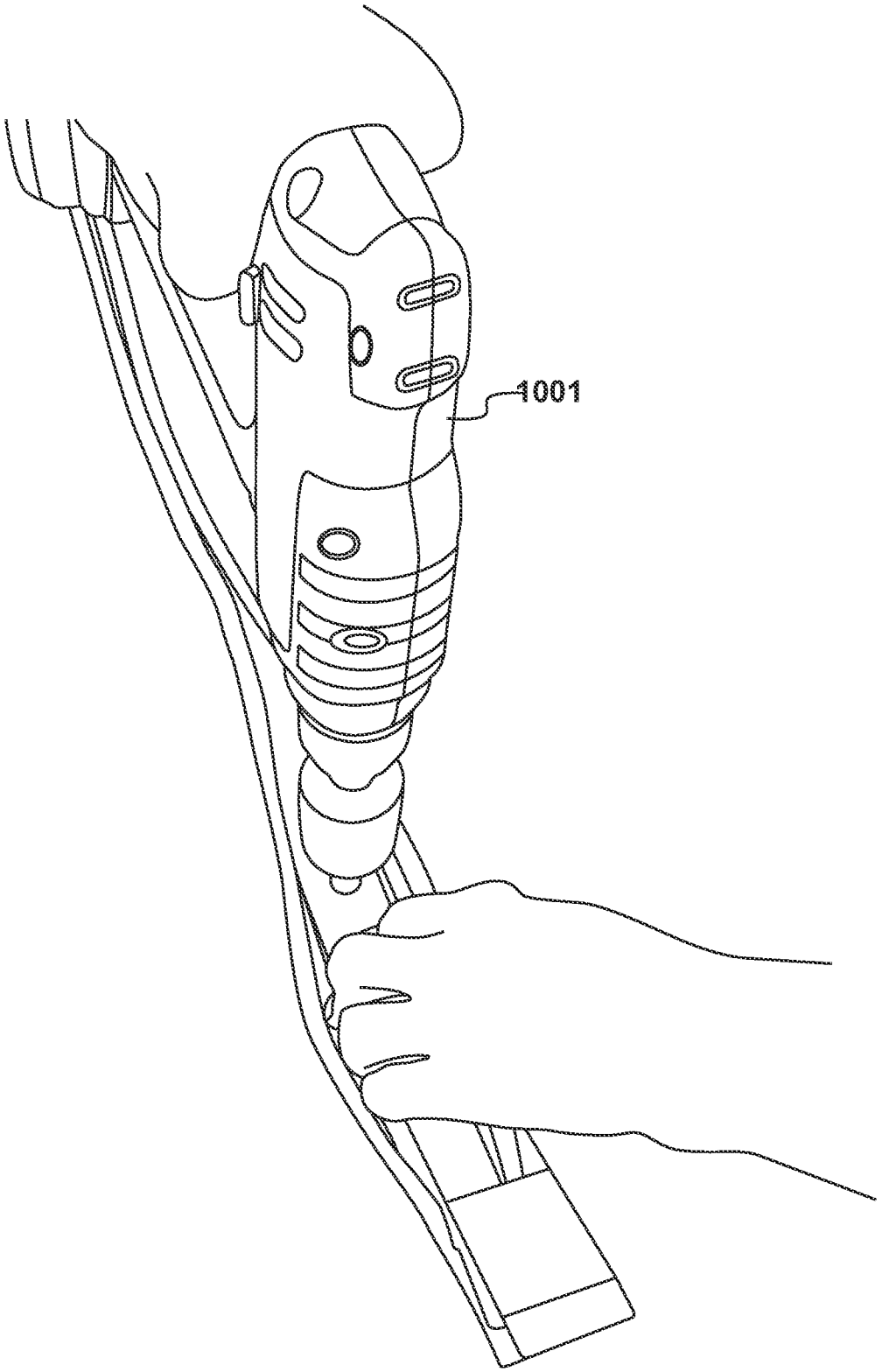
FIG. 10 shows the deployment of a power drill to perform a twist cutting operation.
Figure 11:
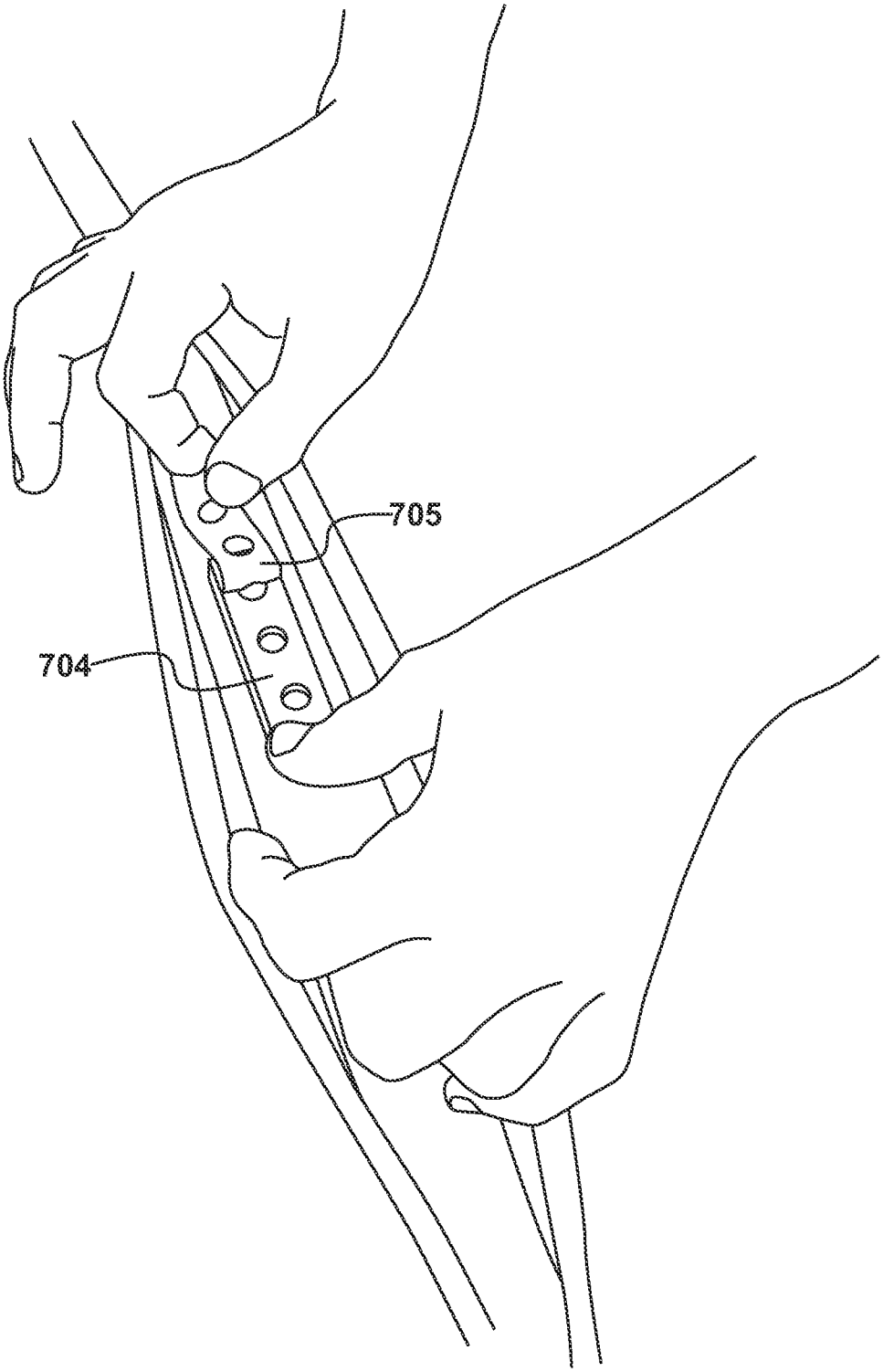
FIG. 11 shows the removal of a protective film.

After the application of the template 901, as described with reference to FIG. 9, a power drill 1001 is deployed to perform a twist cutting operation at the location of each hole 911 to 913. A twist cutting operation is used to create clean cut holes through the second protective film 705, the upper adhesive layer 704, the barrier film 701, the adhered fluorescent material 501 and the reflective tape 502.

FIG. 11

Figure 12:
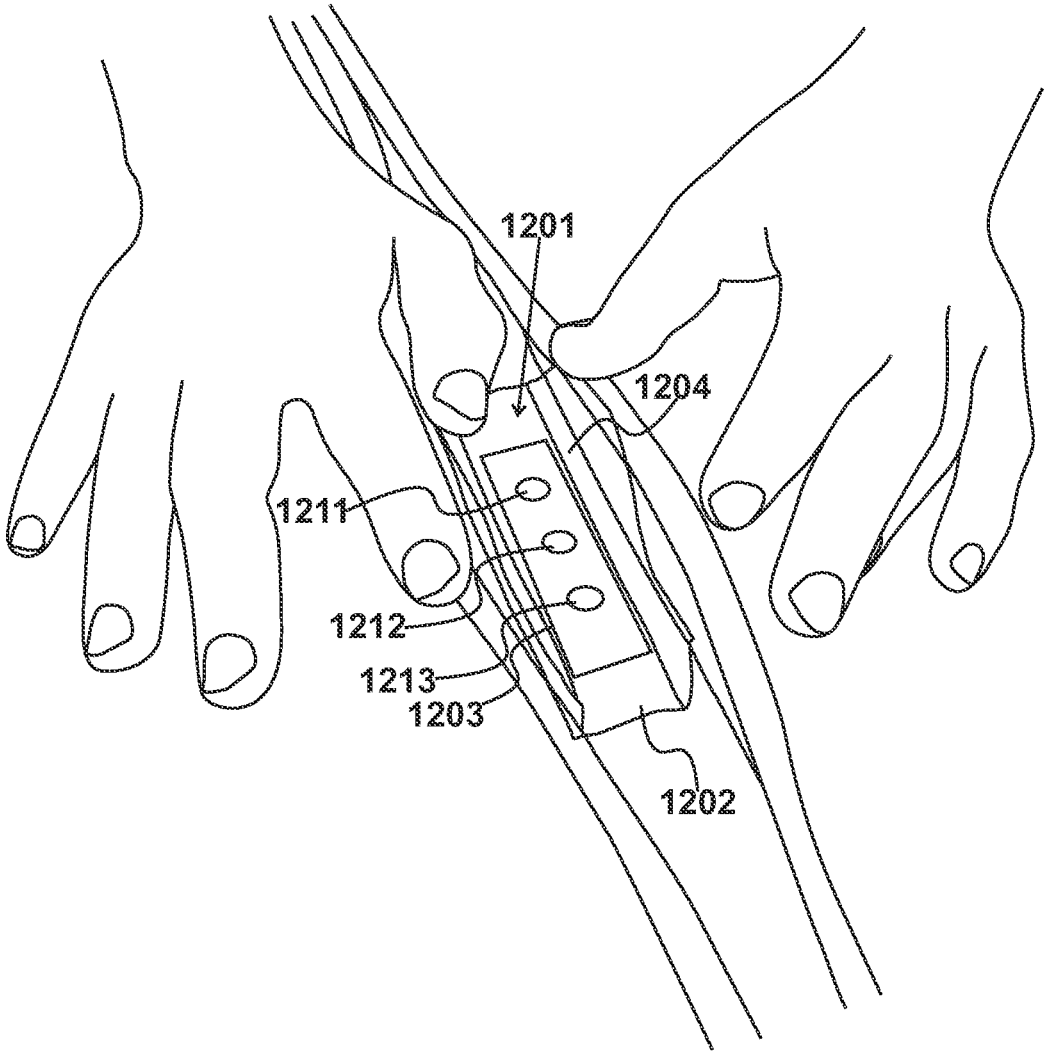
FIG. 12 shows the application of a clear plastics material over the holes.
Figure 13:
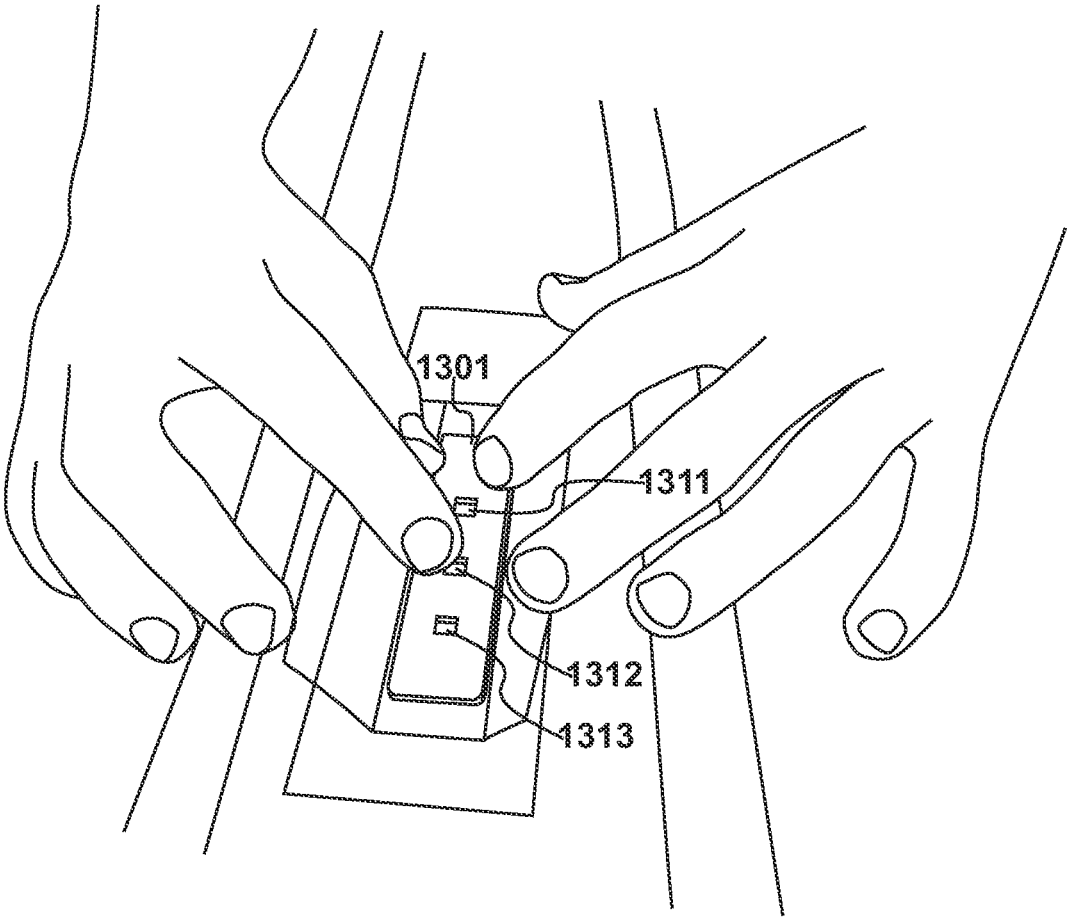
FIG. 13 shows the application of a gasket.

After twist cutting the three holes through the adhesive film, the second protective film 705 is removed, such that the adhesive film now presents the unprotected upper adhesive layer 704 for the reception of a clear plastics material, as described with reference to FIG. 12.

FIG. 12

A clear plastics material 1201 includes a central portion 1202, a first flap 1203 and a second flap 1204.

The central portion 1202 of the clear plastics material 1201 is positioned over the first hole 911, the second hole 912 and the third hole 913 to define respective windows, comprising a first window 1211, a second window 1212 and a third window 1213.

FIG. 13

In an embodiment, a gasket 1301, possibly constructed from a foam-based material, is secured by the upper adhesive layer 704. The gasket 1301 includes a first gasket hole 1311, a second gasket hole 1312 and a third gasket hole 1313. Gasket holes 1311 to 1313 line up with respective windows 1211 to 1213.

FIG. 14

The device strip 303 is located over the gasket 1301. The first gasket hole 1311, the second gasket hole 1312 and the third gasket hole 1313 provide an interference fit for the first light-emitting device 111, the second light-emitting device 112 and the third light-emitting device 113 respectively.

Thus, the light-emitting devices 111 to 113 are retained within respective gasket holes 1311 to 1313 by an application of pressure in the direction of a second arrow 1401.

FIG. 15

Figure 14:
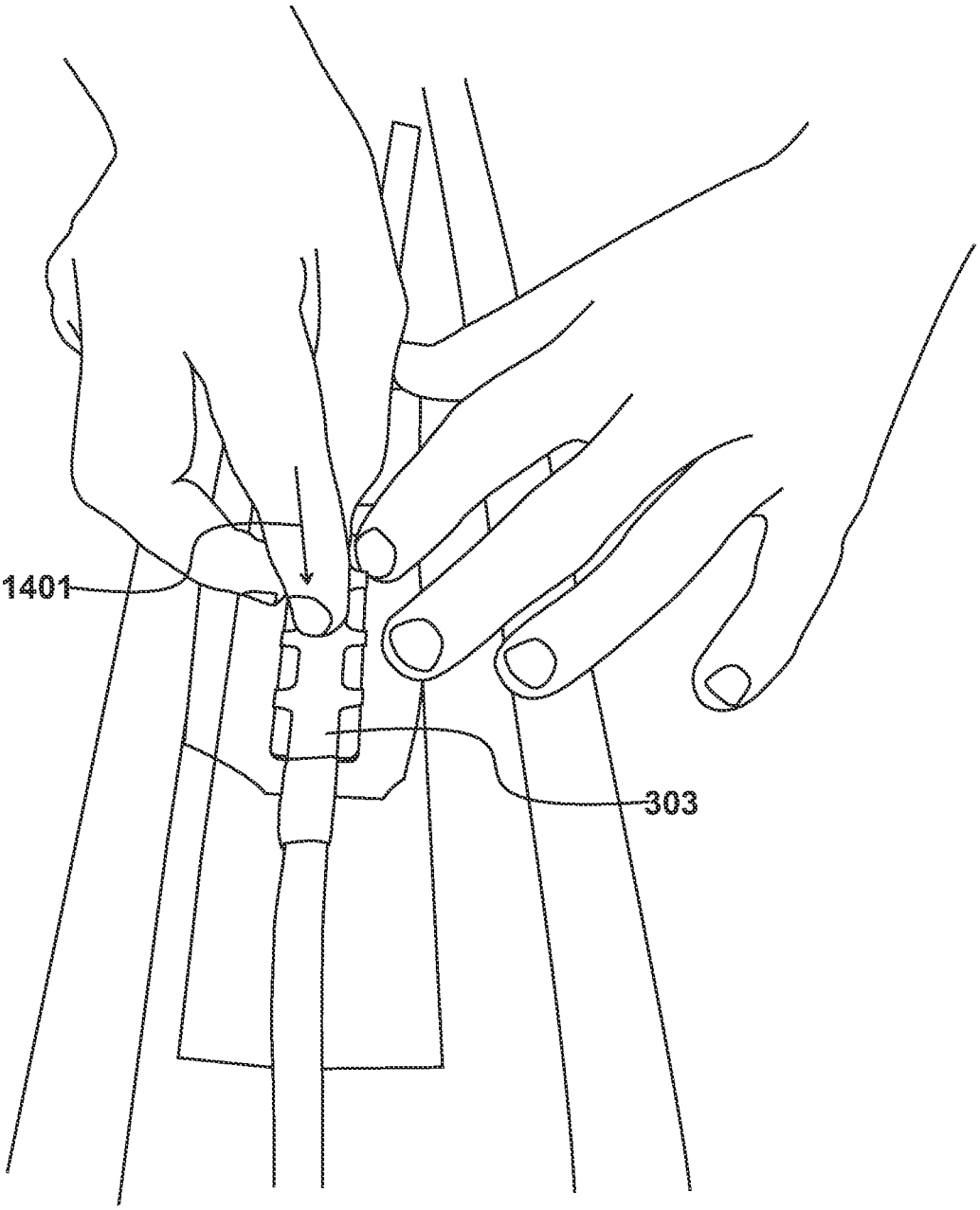
FIG. 14 shows the application of an LED strip over the gasket identified in FIG. 13.
Figure 15:
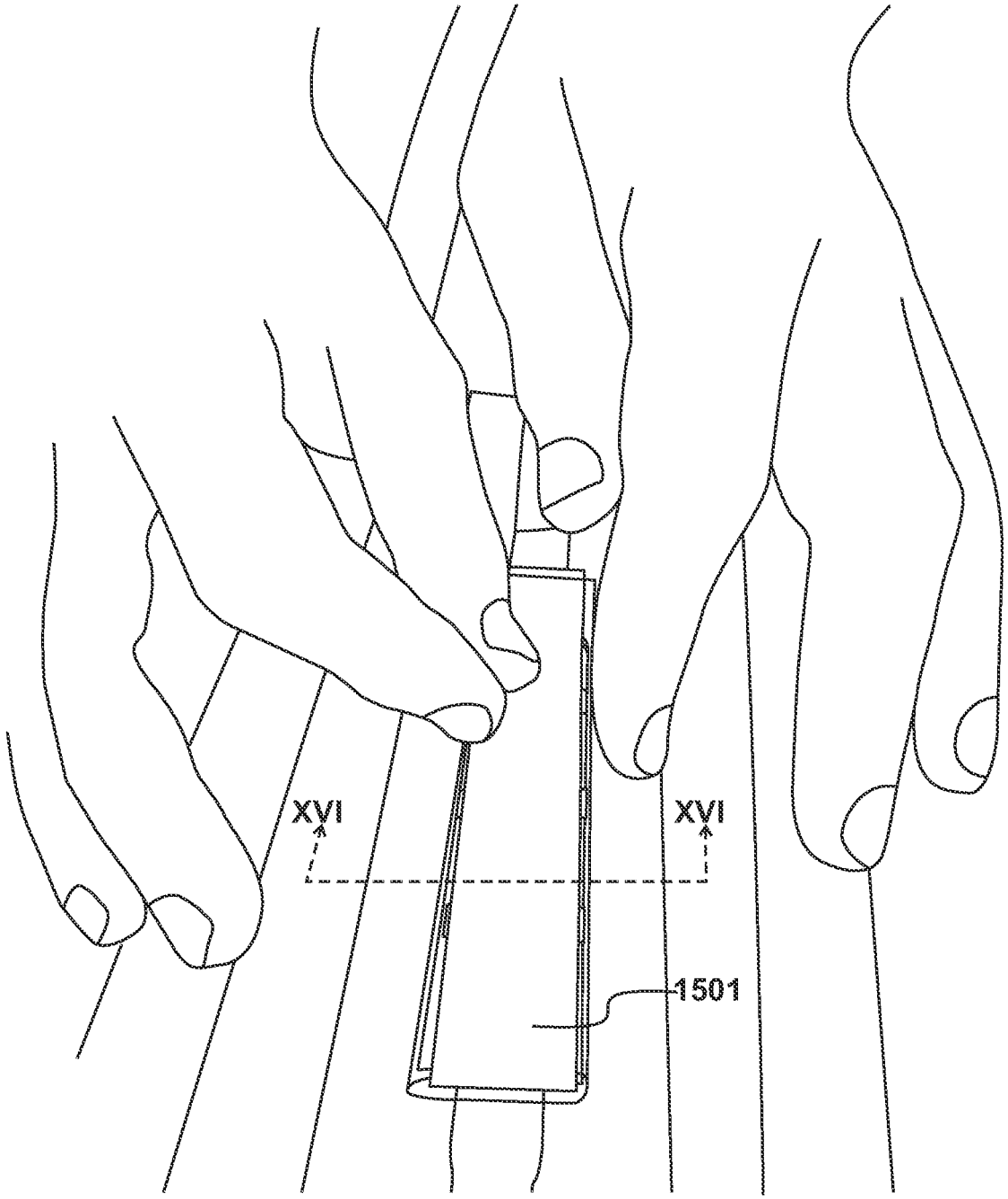
FIG. 15 shows the application of a protective layer and the folding of flaps.

After the light-emitting devices have been received within the holes defined within the gasket 1301, as described with reference to FIG. 14, in an embodiment, a protective layer 1501 is deployed over the device strip 303.

In accordance with an aspect of the present invention, the first flap 1203 is folded over a rear surface of the substrate (the flexible printed circuit board 101) which, in this embodiment, places the first flap 1203 in contact with the protective layer 1401. Thereafter, again in accordance with an aspect of the present invention, the second flap 1204 is further folded over the folded first flap 1203. Furthermore, the whole assembly is made secure and watertight by attaching the further folded second flap to the folded first flap.

FIG. 16

Figure 16:
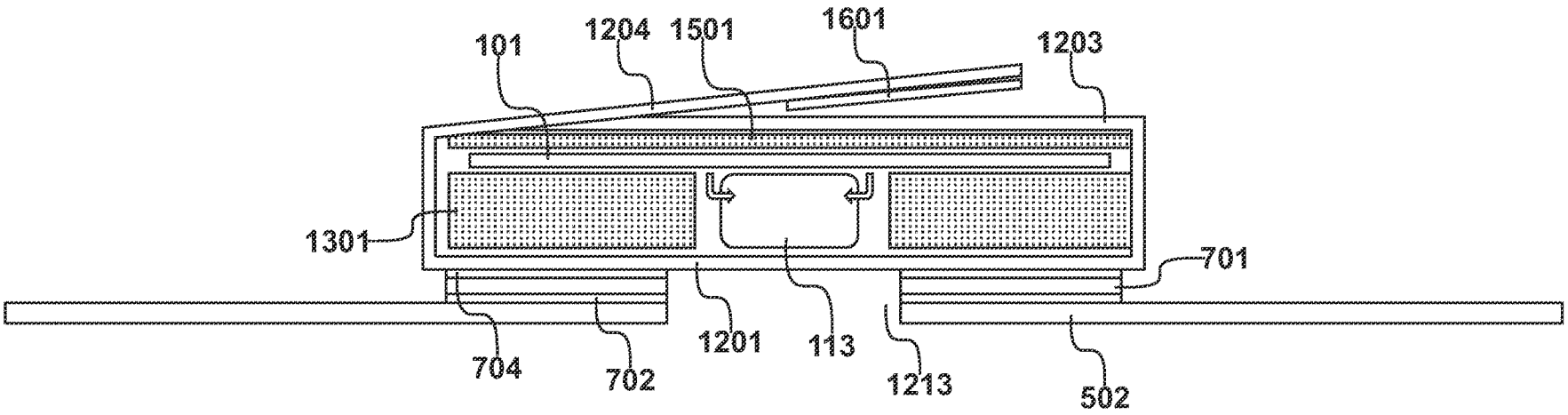
FIG. 16 shows a cross-section of the fully assembled apparatus.

A cross section on line XVI-XVI is shown in FIG. 16, illustrating a fully assembled example of the apparatus. The apparatus therefore provides for the embedding of light-emitting devices connected to a loom of power and data cables and supported on a substrate, within an item of clothing having a strip of a reflective tape surrounded by a fluorescent material. A respective window 1213 is provided for each light-emitting device 113. A hole has been cut through the reflective tape 502 and is covered by a clear plastics material 1201 that defines a first flap 1203 and a second flap 1204.

The first flap 1203 has been folded around the substrate and the substrate is secured by the second flap 1204; by the second flap having been further folded around the first flap 1203. The clear plastics material 1201 is secured to the clothing fabric 502, by the adhesive film 701 through which the holes have also been cut.

In this embodiment, the substrate is a flexible printed circuit board 101. The adhesive film comprises a central barrier layer 701, with reflective tape being adhered thereto by means of a first adhesive layer 702 and the clear plastics material 1201 being adhered thereto by means of an upper adhesive layer 704.

In this embodiment, the gasket 1301 surrounds the light-emitting device 113. The embodiment also includes a protective layer 1501 and an adhesive film 1601 is provided between the first flap 1203 and the second flap 1204 to fully secure the second flap 1204 to the folded first flap 1203.

The invention claimed is:

1. A method of attaching a light-emitting device to an item of clothing, comprising the steps of:

supporting said light-emitting device on a substrate;

connecting power cables to said substrate;

applying an adhesive film to an inside surface of a clothing fabric;

creating a hole through said adhesive film and said clothing fabric at an intended position for said light-emitting device;

positioning a central portion of a clear plastics material over said hole to define a window, such that said central portion is secured by said adhesive film, a first flap extends from a first side of said central portion and a second flap extends from a second side of said central portion;

locating said light-emitting device at the position of said window;

folding said first flap over said substrate;

further-folding said second flap over said folded first flap; and attaching said further folded second flap to said folded first flap to define a sealed enclosure for said substrate.

2. The method of claim 1, wherein plural light-emitting devices are supported by said substrate.

3. The method of claim 2, further comprising the step of connecting a data cable to said substrate.

4. The method of claim 1, wherein said clear plastics material is clear poly vinyl chloride.

5. The method of claim 1, wherein said creating step includes twist-cutting said hole.

6. The method of claim 1, wherein:

said adhesive film comprises:

a central barrier film;

a first adhesive layer on an outer surface; and a second adhesive layer on an inner surface.

7. The method of claim 6, wherein said applying step includes the steps of:

removing a first backing material from said first adhesive layer;

locating said first adhesive layer upon said inside surface of said clothing fabric; and applying heat and pressure to a second backing material attached to said second adhesive layer.

8. The method of claim 1, further comprising the step of positioning a gasket around said light-emitting device prior to said locating step.

9. The method of claim 7, further comprising the step of removing said second backing material prior to said positioning step.

10. The method of claim 9, further comprising the step of arranging a protective layer behind said substrate prior to said folding step.

11. The method of claim 1, further comprising the steps of:

deploying an adhesive tape over an outer surface of said first flap after said folding step; and securing an inner surface of said second flap to said adhesive tape after said further-folding step.

12. The method of claim 1, wherein said applying step applies said adhesive film at the position of a reflective tape.

13. An apparatus defining an item of clothing having a strip of a reflective tape surrounded by florescent material, comprising:

light-emitting devices connected to a loom of power and data cables and supported on a substrate; and said reflective tape comprising holes for windows for each respective light-emitting device of said light-emitting devices, wherein:

said holes in said reflective tape are covered by a clear plastics material having a first flap and a second flap;

said light-emitting devices are embedded such that said first flap is folded around said substrate;

said substrate is secured by said second flap being further folded around said first flap; and said clear plastics material is secured to a clothing fabric by an adhesive film through which holes have been cut to correspond with said holes in said reflective tape.

14. The apparatus of claim 13, wherein said substrate is a flexible printed circuit board.

15. The apparatus of claim 14, wherein:

plural light-emitting devices are surface mounted onto said flexible printed circuit board; and said power and data cables are connected to said flexible printed circuit board.

16. The apparatus of claim 15, wherein rubber over-mouldings are applied at positions where said power and data cables connect to said flexible printed circuit board.

17. The apparatus of claim 13, wherein said adhesive film comprises:

a central barrier film;

a first adhesive layer; and a second adhesive layer.

18. The apparatus of claim 13, further comprising respective gaskets surrounding each said light-emitting device of said light-emitting devices.

19. The apparatus of claim 13, further comprising a protective layer between said substrate and said first flap.

20. The apparatus of claim 13, further comprising an adhesive tape between said first flap and said second flap.

* * * * *